US005923918A

United States Patent [19]

Nakagawa et al.

[11] Patent Number: 5,923,918

[45] Date of Patent: Jul. 13, 1999

[54] DEVICE FOR NOTIFYING A REMAINING AMOUNT OF A DEVELOPER, A PROCESS CARTRIDGE, AND AN ELECTROPHOTOGRAPHIC IMAGE FORMING APPARATUS

[75] Inventors: Takao Nakagawa, Numazu; Tadayuki Tsuda, Susono; Shinichi Sasaki, Fujisawa, all of Japan

[73] Assignee: Canon Kabushiki Kaisha, Tokyo, Japan

[21] Appl. No.: 08/962,644

[22] Filed: Nov. 3, 1997

[30] Foreign Application Priority Data

Nov. 9, 1996 [JP] Japan ..... 8-312948
Aug. 21, 1997 [JP] Japan ..... 9-224873

[51] Int. Cl.[6] ..... G03G 15/08

[52] U.S. Cl. ..... 399/27; 399/27

[58] Field of Search ..... 399/24, 25, 27, 399/258, 262

[56] References Cited

U.S. PATENT DOCUMENTS 4,632,534 12/1986 Shimono ..... 399/27
5,134,441 7/1992 Nagata et al. ..... 399/103
5,510,878 4/1996 Noda et al. ..... 399/111

OTHER PUBLICATIONS

"Toner Level Sensor", R. Feldeisen, Xerox Disclosure Journal, vol. 5, No. 1, Jan./Feb. 1980, p. 85.

*Primary Examiner*—William Royer
*Attorney, Agent, or Firm*—Fitzpatrick, Cella, Harper & Scinto

[57] ABSTRACT

A developer-remaining-amount notifying device for notifying a remaining amount of a developer accommodated in a developer accommodating unit and used for developing a latent image formed on an electrophotographic photosensitive member is provided. The device includes a position detection member positionable near an upper surface of an accumulated layer of the developer accommodated in the developer accommodating unit, a regulating member, and a notification device. The regulating member regulates a moving direction of the position detection member such that the position detection member moves substantially linearly in accordance with a gradual decrease of the developer accommodated in the developer accommodating unit as the developer is used for development. The notification device notifies a remaining amount of the developer accommodated in the developer accommodating unit in accordance with a position of the position detection member.

29 Claims, 10 Drawing Sheets

DEVICE FOR NOTIFYING A REMAINING AMOUNT OF A DEVELOPER, A PROCESS CARTRIDGE, AND AN ELECTROPHOTOGRAPHIC IMAGE FORMING APPARATUS

BACKGROUND OF THE INVENTION

1. Field of the Invention

This invention relates to a device for notifying a remaining amount of a developer accommodated in a developer accommodating unit for accomodating the developer used for developing a latent image formed on an electrophotographic photosensitive member, to a process cartridge including such a device, and to an electrophotographic image forming apparatus including such a process cartridge.

The electrophotographic image forming apparatus forms an image on a recording medium using an electrophotographic image forming method. Electrophotographic image forming apparatuses include electrophotographic copiers, electrophotographic printers (such as laser-beam printers, LED (light-emitting diode) printers, and the like), facsimile apparatuses, word processors, and the like.

One type of process cartridge includes at least developing means and an electrophotographic photosensitive member integrally formed as a cartridge, which is detachably mounted on the main body of an electrophotographic image forming apparatus. Another type of process cartridge includes developing means, at least one of charging means and cleaning means, and an electrophotographic photosensitive member integrally formed as a cartridge, which is detachably mounted on the main body of an electrophotographic image forming apparatus. According to such a process cartridge method, since the user can detachably mount a process cartridge on the main body of an image forming apparatus, maintenance of the main body of the apparatus can be easily performed.

2. Description of the Related Art

In conventional electrophotographic image forming apparatuses using an electrophotographic image forming process, the process cartridge method, in which an electrophotographic photosensitive member and process means operating thereon are integrally formed as a cartridge that is detachably mounted on the main body of the apparatus, is adopted. According to the process cartridge method, since the user can perform maintenance of the apparatus instead of a serviceman, the operability of the apparatus can be greatly improved. Accordingly, the process cartrige method has been widely used in electrophotographic image forming apparatuses.

It is necessary to replace this type of process cartridge with a new one when an incorporated toner (developer) is completely consumed. Hence, there is an attempt to provide means for notifying a remaining amount of a toner being used (a developer-remaining-amount notifying device).

SUMMARY OF THE INVENTION

It is an object of the present invention to provide a developer-remaining-amount notifying device which can detect a remaining amount of a developer, a process cartridge including such a device, and an electrophotographic image forming apparatus including such a cartridge.

It is another object of the present invention to provide a developer-remaining-amount notifying device which sequentially notifies a remaining amount of a developer, a process cartridge including such a device, and an electrophotographic image forming apparatus including such a cartridge.

To achieve the above objects, the developer-remaining-amount notifying device for notifying a remaining amount of a developer accommodated in a developer accommodating unit and used for developing a latent image formed on an electrophotographic photosensitive member of the present invention provides a position detection member, a regulating member, and notification means. The position detection member is positionable near an upper surface of an accumulated layer of the developer accommodated in the developer accommodating unit. The regulating member regulates a moving direction of the position detection member such that the position detection member moves substantially linearly in accordance with a gradual decrease of the developer accommodated in the developer accommodating unit as the developer is used for development. The notification means notifies a remaining amount of the developer accommodated in the developer accommodating unit in accordance with a position of the position detection member.

In another aspect, the present invention provides a process cartridge detachably mountable on a main body of an electrophotographic image forming apparatus. The process cartridge includes an electrophotographic photosensitive member, developing means including a developing member for developing a latent image formed on the electrophotographic photosensitive member, and a developer accommodating unit for accommodating a developer used by the developing member for development, and a developer-remaining-amount notification unit for notifying a remaining amount of the developer accommodated in the developer accommodating unit. The developer-remaining-amount notification unit includes a position detection member, a regulating member, and notification means. The position detection member is positionable near an upper surface of an accumulated layer of the developer accommodated in the developer accommodating unit. The regulating member regulates a moving direction of the position detection member such that the position detection member moves substantially linearly in accordance with a gradual decrease of the developer accommodated in the developer accommodating unit as the developer is used for development. The notification means notifies a remaining amount of the developer accommodated in the developer accommodating unit in accordance with a position of the position detection member.

In yet another aspect, the present invention provides an electrophotographic image forming apparatus for forming an image on a recording medium. The apparatus includes a mounting unit for detachably mounting a process cartridge, and a main body notification means. The process cartridge includes an electrophotographic photosensitive member, developing means including a developer accommodating unit for accommodating a developer for developing a latent image formed on the electrophotographic photosensitive member, and a developer-remaining-amount notification unit for notifying a remaining amount of the developer accommodated in the developer accommodating unit. The developer-remaining-amount notification unit includes a position detection member positionable near an upper surface of an accumulated layer of the developer accommodated in the developer accommodating unit, a regulating member, and notification means. The regulating member regulates a moving direction of the position detection member such that the position detection member moves substantially linearly in accordance with a gradual decrease of the developer accommodated in the developer accommodating unit as the developer is used for development. The notification means notifies the remaining amount of the developer accommodated in the developer accommodating unit in accordance with a position of the position detection member. The main body notification unit notifies the remaining amount of the developer accommodated in the developer accommodating unit by receiving a signal from the notification means when the process cartridge is mounted to the mounting unit.

The foregoing and other objects, advantages and features of the present invention will become more apparent from the following description of the preferred embodiments taken in conjunction with the accompanying drawings.

BRIEF DESCRIPTION OF THE DRAWINGS

FIG. 3(*a*) illustrates a cross section of the surrounding structure of a toner receptacle of the process cartridge, and the developer-remaining-amount notifying device; and FIG. 3(*b*) is a cross-sectional view of an expansion bar constituting the developer-remaining-amount notifying device;

FIG. 6(*a*) illustrates the tape; and FIG. 6(*b*) illustrates the detector;

FIG. 7(*a*) illustrates the string; and FIG. 7(*b*) illustrates the detector;

FIG. 9(*a*) illustrates the tape; and FIG. 9(*b*) illustrates the detection window.

DESCRIPTION OF THE PREFERRED EMBODIMENTS

Preferred embodiments of the present invention will now be described in detail with reference to the drawings.

In the embodiments, a developer-remaining-amount notifying device is applied to a process cartridge which is detachably mounted in an electrophotographic image forming apparatus (hereinafter termed an "image forming apparatus"), such as an electrophotographic copier, a laser-beam printer or the like, and to the image forming apparatus.

First Embodiment

Figure 1:
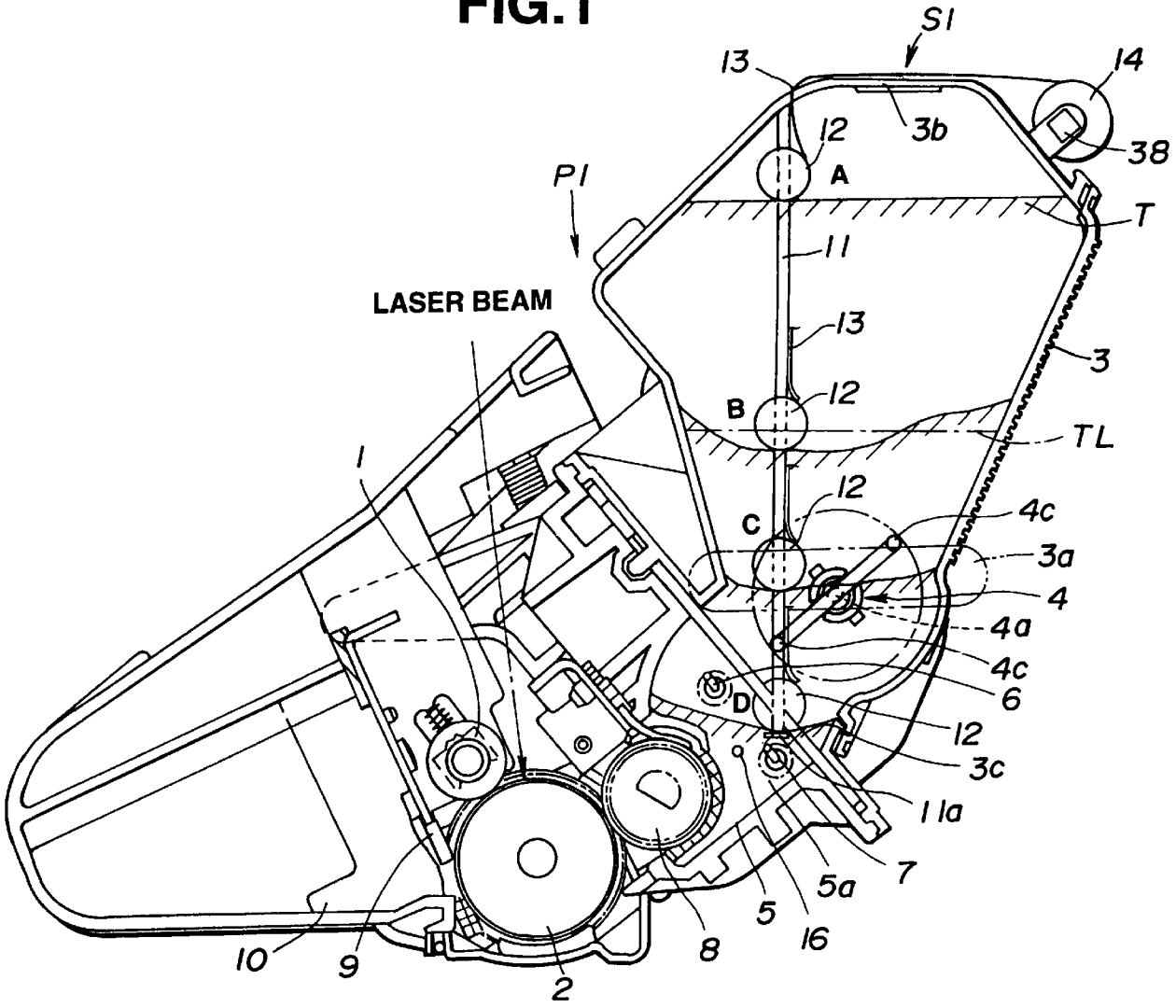
FIG. 1 is a diagram illustrating a process cartridge and a developer-remaining-amount notifying device used in an image forming apparatus according to a first embodiment of the present invention, and shows a cross section of a principal portion of the process cartridge, and the movement of a float of the developer-remaining-amount notifying device in accordance with a gradual consumption of toner.
Figure 2B:
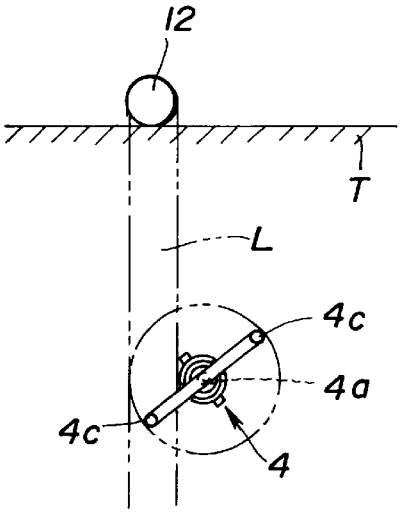
FIGS. 2(*a*) and 2(*b*) are a front view and a side view, respectively, illustrating the positional relationship between the locus of descent of the float of the developer-remaining-amount notifying device and a stirrer.
Figure 8:
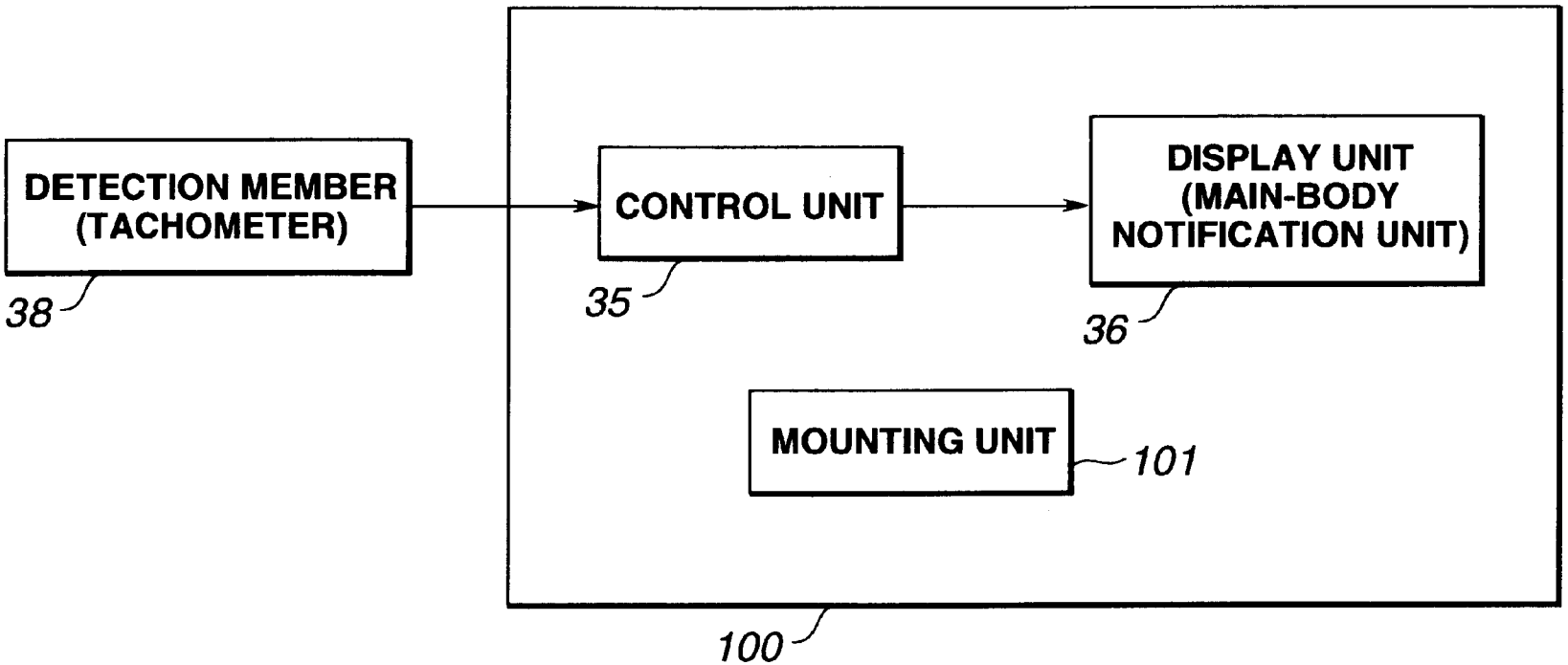
FIG. 8 is a block diagram illustrating a control system for displaying the remaining amount of a toner in a developer-remaining-amount notifying device and a process cartridge used in an image forming apparatus in the present invention.

A description will now be provided of a developer-remaining-amount notifying device, a process cartridge, and an image forming apparatus according to a first embodiment of the present invention with reference to FIGS. 1, 2(*a*), 2(*b*) and 8. FIG. 1 is a diagram illustrating a cross section of a principal portion of the process cartridge, and the movement of a float (a position detection member) of the developer-remaining-amount notifying device in accordance with a gradual consumption of toner. FIGS. 2(*a*) and 2(*b*) are a front view and a side view, respectively, illustrating the positional relationship between the locus of descent of the float and a stirrer. FIG. 8 is a block diagram illustrating a control system for notifying the remaining amount of the toner in the developer-remaining-amount notifying device, the process cartridge, and the image forming apparatus.

First, a description will be provided of an image forming process using the process cartridge.

In FIG. 1, symbol P1 represents the process cartridge which includes a drum-shaped electrophotographic photosensitive member (hereinafter termed a "photosensitive drum"). The process cartridge P1 also includes a charging roller 1, serving as charging means for uniformly charging the photosensitive drum 2. The process cartridge P1 further includes developing means including a developing sleeve 8 for developing a latent image, formed on the photosensitive drum 2 by image light projected thereon, using a developer, and a toner receptacle 3, serving as a developer accommodating unit for accommodating a toner T, serving as the developer. In addition, the process cartridge P1 includes a cleaning blade 9, serving as cleaning means for removing toner particles remaining on the photosensitive drum 2 after transferring the developed image on the photosensitive drum 2 onto a transfer material. The photosensitive drum, the developing means and the cleaning means are integrally formed as a cartridge, which is detachably mounted in a main body 100 of the image forming apparatus.

The copying process of the process cartridge P1 is as follows. First, an image signal provided from the main body 100 of the image forming apparatus is converted into a laser beam. The laser beam is projected onto the rotating photosensitive drum 2, which has been uniformly charged by the charging roller 1, to form a latent image. Then, the toner (developer) T, stirred by a stirrer 4, serving as a developer stirring member within the toner receptacle 3, is supplied to a developing unit 5. The toner T supplied to the developing unit 5 is sufficiently loosened by an upper stirrer 6 and lower stirrer 7, and is then transferred to a portion where the latent image has been formed by the laser beam projected onto the photosensitive drum 2, to form a toner image (developer image). The toner image on the photosensitive drum 2 is transferred onto a transfer material (recording medium) fed by a recording-medium supply mechanism and a sheet feeding mechanism (not shown) in the main body 100 of the image forming apparatus. Toner particles remaining on the photosensitive drum 2 without being transferred are removed by being scraped off by the cleaning blade 9 into a waste-toner receptacle 10.

Next, a description will be provided of the developer-remaining-amount notifying device used in the above-described process cartridge and the image forming apparatus.

In FIG. 1, symbol S1 represents the developer-remaining-amount notifying device, which is provided within the toner receptacle 3 of the process cartridge P1. In addition to the above-described stirrer 4 for stirring the filled toner T, a regulating member 11 constituting a part of the developer-remaining-amount notifying device S1 is mounted within the toner receptacle 3.

The regulating member 11 and a position detection member provided thereon will now be described.

The regulating member 11 regulates the moving direction of the position detection member. In the regulating member 11, it is preferable that a float 12 (to be described later), serving as the position detection member, is provided within an empirically predetermined region where the decrease in toner represents an average decrease. In the first embodiment, the regulating member 11 is disposed by being threaded near the center of the upper surface of the toner layer, i.e., near the center of the horizontal cross section of the toner receptacle 3. The regulating member 11 extends in the moving direction (substantially vertical direction) of the position of the upper surface of the toner due to gradual consumption of the toner. One end (the upper end) of the regulating member 11 is fixed to the back surface of an upper wall 3*b* of the toner receptacle 3, and the other end (the lower end) of the regulating member 11 enters a developing chamber 5*a* of the developing unit 5 after passing through the stirrer 4 and a toner supply opening 3*c* below the stirrer 4. The regulating member 11 has a flangeshaped stopper unit 11*a* at the distal end of the other end in order to define the lowest position of descent of the float 12. The stopper unit 11*a* is not necessarily provided at the regulating member 11, but may also be provided on a wall of the toner receptacle 3.

The float 12 serving as the position detection member is movably threaded through the regulating member 11. Accordingly, the float 12 can move along the regulating member 11 in a substantially vertical direction (longitudinal direction) of the toner receptacle 3. Although in the first embodiment, a cylindrical float extending in a lateral direction (a direction perpendicular to the plane of FIG. 1) of the toner receptacle is used, a spherical float may also be used.

The regulating member 11 is not necessarily linear as shown in FIG. 1, but may also have any other shape adjusted to the shape of the toner receptacle 3 provided that the float 12 is allowed to be positioned near the center of the upper surface of the moving toner layer.

Next, a description will be provided of notification means, which notifies the remaining amount of the developer accommodated within a developer accommodating unit (for example, the toner receptacle 3) in accordance with the position of a position detection member (for example, the float 12), moving in a state in which the moving direction is regulated by the regulating member 11 in a substantially vertical direction.

A thread 13, a thread accommodating member (reel) 14 and a detection member 34 constituting the notification means will now be described.

First, the thread 13 will be described. One end of the thread 13 is fixed to the float (position detection member) 12, and the other end of the thread 13 is accommodated by being wound around the reel 14, serving as a thread accommodating member, provided on the surface of the upper wall 3*b* of the toner receptacle 3.

Next, the thread accommodating member 14 will be described. The reel (thread accommodating member) 14 is configured so as to be rotatably operated from the outside of the toner receptacle 3, for example, by means of a mechanical or electrical connection in a state in which the process cartridge P1 is mounted in the main body 100 of the image forming apparatus. The reel 14 may also be provided within the toner receptacle 3 so as to be rotatably operated from the outside of the toner receptacle 3, for example, by means of a mechanical or electrical connection.

Next, a description will be provided of the detection member 38. The detection member 38 is connected to the reel (thread or string accommodating member) 14, and measures the amount of rotation of the reel 14 caused by the movement of the thread or string 13 drawn in accordance with the descent of the float 12. The detection member (tachometer) 38 outputs an electrical signal corresponding to the amount of rotation to a control unit provided in the main body 100 of the image forming apparatus, for example, a control unit for controlling the entire image forming apparatus. In the first embodiment, an encoder or the like is used as the tachometer 38.

The tachometer 38 may also be provided within the main body 100 of the image forming apparatus so as to be mechanically or electrically connected to the reel 14 of the process cartridge P1 when the process cartridge P1 is mounted, and to output an electrical signal corresponding to the amount of rotation of the reel 14 to the control unit.

Next, the stirrer 4 provided in the process cartridge P1 will be described in more detail.

As shown in FIG. 2(*a*), one end 4*b* of a supporting shaft of the stirrer 4 is fitted in the toner receptacle 3, and the other end 4*d* of the supporting shaft is engaged with a stirring shaft 15 mounted on the toner receptacle 3. The stirring shaft 15 rotates the stirrer 4 by being driven by a gear train (not shown) for driving the photosensitive drum 2, the developing sleeve 8 and the like of the process cartridge P1.

As shown in FIGS. 2(*a*) and 2(*b*), the stirring shaft 15 has a second stirring portion 4*a* facing the locus of descent L of the float 12 (indicated by two-dot chain lines). The second stirring portion 4*a* is set at the same height as the supporting shaft portions 4*b* and 4*d*, and the radius of rotation of the second stirring portion 4*a* is smaller than that of first stirring portions 4*c* provided at both sides of the second stirring portion 4*a* (see FIG. 2(*b*)). Hence, the passage of the float 12 is not hindered by the rotation of the stirrer 4. The second stirring portion 4*a* can be provided so as to be greatly separated from the locus of descent L of the float 12 depending on the shape and the configuration of the toner receptacle 3, for example, if the toner receptacle 3 has the shape of a rectangular parallelepiped.

The main role of the stirrer 4 is to prevent gathering of the toner that occurs because the toner receptacle 3 is narrow at its lower portion 3*a* (see FIG. 1). In the first embodiment, the length of the float 12 in the longitudinal direction (the entire length) is sufficiently shorter than the length of the toner receptacle 3 in the same direction (the inner size in a direction perpendicular to the plane of FIG. 1 (see FIG. 2(*a*), and the second stirring portion 4*a* of the stirrer 4 is shorter than the entire length of the stirrer 4. Accordingly, even if toner particles in the vicinity of the second stirring portion 4*a* are not stirred, surrounding toner particles are stirred by the first stirring portions 4*c* and drop toward the toner supply opening 3*c* of the developing unit 5, thereby causing the toner particles in the vicinity of the second stirring portion 4*a* to drop. Although the stirring operation of the second stirring portion 4*a* present near the center of the upper surface of the toner layer does not much contribute to stirring of toner particles, surrounding toner particles are stirred by the first stirring portions 4*c*, so that gathering of the toner T in the lower portion 3*a* of the toner receptacle 3 can be assuredly prevented.

Next, a description will be provided of sequential detection of the remaining amount of the toner in accordance with gradual consumption of the toner performed by the developer-remaining-amount notifying device S1 with reference to FIG. 2(*b*).

In a toner filling process in a process of assembling the process cartridge P1, the string 13 is wound around the reel 14 before filling the toner, and the float 12 is positioned at an upper portion of the toner receptacle 3. By applying a stopper (not shown) to the reel 14 in this state and releasing the stopper by the user when using the process cartridge P1, the float 12 can be placed on the upper surface of the toner layer (an initial state A—FIG. 1).

When the process cartridge P1 has been mounted in a mounting unit 101 (FIG. 8) of the main body 100 of the image forming apparatus, and as the toner T within the toner receptacle 3 is gradually consumed, a central portion of the upper surface of the toner layer tends to be concave relative to a portion near the wall of the toner receptacle 3 due, for example, to the flowability of the toner T and the friction of the toner T with the wall of the toner receptacle 3 (a state B). However, since the regulating member 11 having the float 12 threaded therethrough is disposed near the center of the upper surface of the toner layer, the float 12 moving along the regulating member 11 can always follow the concave portion of the upper surface of the toner layer. Accordingly, even if gathering of the toner occurs due, for example, to a decrease in the flowability of the toner and the friction of the toner with the toner receptacle 3, a portion near the center of the upper surface of the toner layer is not influenced by the gathering of the toner, so that sequential detection of the remaining amount of the toner by the float 12 can be assuredly performed.

Next, a description will be provided of a case in which the float 12 is positioned at the lower portion 3*a* of the toner receptacle 3 and passes through a portion near the stirrer 4 (a state C) as a result of further consumption of the toner. The stirring shaft 15 of the stirrer 4 disposed near the lower portion 3*a* of the toner receptacle 3 is driven by the above-mentioned gear train to perform stirring, and the flowability of the toner T appropriately increases by being stirred by the stirrer 4. The second stirring portion 4*a* of the stirrer 4 is set at substantially the same height as the supporting shaft portions 4*b* and 4*d* and has a smaller radius of rotation than the radius of rotation of the first stirring portions 4*c*. Hence, as shown in FIG. 2(*b*), the second stirring portion 4*a* does not hinder the passage of the float 12 even if the stirrer 4 rotates. Accordingly, a portion near the center of the upper surface of the toner layer is not influenced by the stirrer 4, so that sequential detection of the remaining amount of the toner by the float 12 can be assuredly performed.

When the toner is further consumed and the remaining amount of the toner becomes small (a state D), the stopper unit (or portion) 11*a* of the regulating member 11 hinders further descent of the float 12, so that the sequential detection of the remaining amount of the toner is terminated at this position.

When the sequential detection of the remaining amount of the toner has been terminated in the above-described manner, detection of an end of the amount of the toner by an antenna line 16 disposed in parallel to the developing sleeve 8 is performed. In this detection, the amount of the toner is detected utilizing a change in the electrostatic capacitance between the antenna line 16 and the developing roller (or sleeve) 8 when applying voltages to both of them. That is, if the toner T is present between the antenna line 16 and the developing roller 8, the electrostatic capacitance is low. On the other hand, if the toner T is absent, the electrostatic capacitance is high. The presence/absence of the toner T is determined by detecting the amount of the toner utilizing the above-described fact. Thus, auxiliary notification means for notifying the remaining amount of the developer according to a change in the electrostatic capacitance between the antenna line (antenna member) 16 and the developing roller (developing member) 8 is provided. This auxiliary notification means notifies a remaining amount which is lower than the remaining amount notified by the above-described notification means.

In such sequential detection of the remaining amount of the toner, the float 12 descends in accordance with changes A→B→C→D of the upper surface of the toner layer, whereby the string 13 is drawn from the reel 14 to rotate the reel 14. As shown in FIG. 8, the tachometer 38 outputs an electrical signal corresponding to the amount of rotation of the reel 14 to a control unit 35 comprising a CPU (central processing unit) and the like. The control unit 35 calculates the position of the float 12 based on the electrical signal and converts the obtained value into the remaining amount of the toner.

The control unit 35 displays the current remaining amount of the toner, obtained as a result of sequential detection of the remaining amount of the toner by the float 12, on a display unit 36 (main-body notification unit) provided on the main body 100 of the image forming apparatus, to notify the user of the remaining amount of the toner.

When the sequential detection of the remaining amount of the toner by the float 12 has ended, the fact that a time to exchange the cartridge or to replenish the toner approaches is displayed on the display unit 36 to notify the user of this fact. Thereafter, complete consumption of the toner T by the detection of an end of the amount of the toner by the antenna line 16 is displayed on the display unit (main-body notification unit) 36 to notify the user of this fact. The display unit 36 may be provided on the main body 100 of the image forming apparatus, or may be a display of an external apparatus.

As described above, in the developer-remaining-amount detection device S1, the regulating member 11 is disposed from the upper wall 3*b* to a portion near the base of the toner receptacle 3 so that the float 12 passes through a portion near the center of the upper surface of the toner layer, i.e., near the center of the horizontal cross section of the toner receptacle 3, along the shape of the toner receptacle 3. Hence, the float 12 can descend to a position near the base of the toner receptacle 3 in accordance with changes in the upper surface of the toner layer due to gradual consumption of the toner, so that the amount of the toner can be notified until the remaining amount of the toner is very small.

In the detection by the float 12, since the concave portion of the upper surface of the toner layer detected by the float 12 is lower than the average level TL (indicated by a one-dot chain line in the state B shown in FIG. 1), the remaining amount of the toner is not exactly determined. However, the detection of the concave portion of the upper surface of the toner layer by the float 12 is effective from the viewpoint of notifying the user of consumption of the toner before the toner is actually completely consumed.

If the float 12 is buried within the toner layer when, for example, replenishing the toner, the float 12 is first raised by winding the string 13 around the reel 14 and the amount of rotation up to this time is reset, and the float 12 is then lowered. Thus, the float 12 touches again the surface of the toner layer, so that the remaining amount of the toner can be detected.

It is desirable that the raising of the float 12 and the resetting of the amount of rotation are performed in the above-described manner when mounting the process cartridge P1 (immediately after an insertion cover for the process cartridge P1 provided in the main body 100 of the image forming apparatus, or a toner supply port (not shown) provided in the process cartridge P1 has been closed).

In a state in which the float (position detection member) 12 is maintained at a position near the center of the upper surface of the toner layer by the regulating member 11 extending in the moving direction (substantially vertical direction) of the upper surface of the toner layer, the float 12 can descend in accordance with the movement of the upper surface of the toner layer due to gradual consumption of the toner without moving toward the wall of the toner receptacle (developer accommodating unit) 3. Accordingly, it is possible to prevent the problem that the float 12 stops at a portion of gathering of the toner (developer) due, for example, to a decrease in the flowability of the toner and the friction of the toner with the toner receptacle 3 and cannot follow the toner layer, and therefore to perform exact sequential notification of the remaining amount of the toner.

Second Embodiment

Figure 3B:
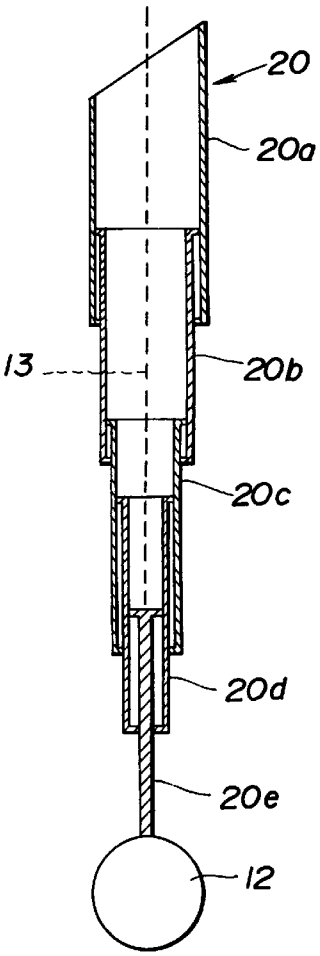
FIGS. 3(*a*) and 3(*b*) are diagrams illustrating a process cartridge and a developer-remaining-amount notifying device used in an image forming apparatus according to a second embodiment of the present invention.
Figure 3A:
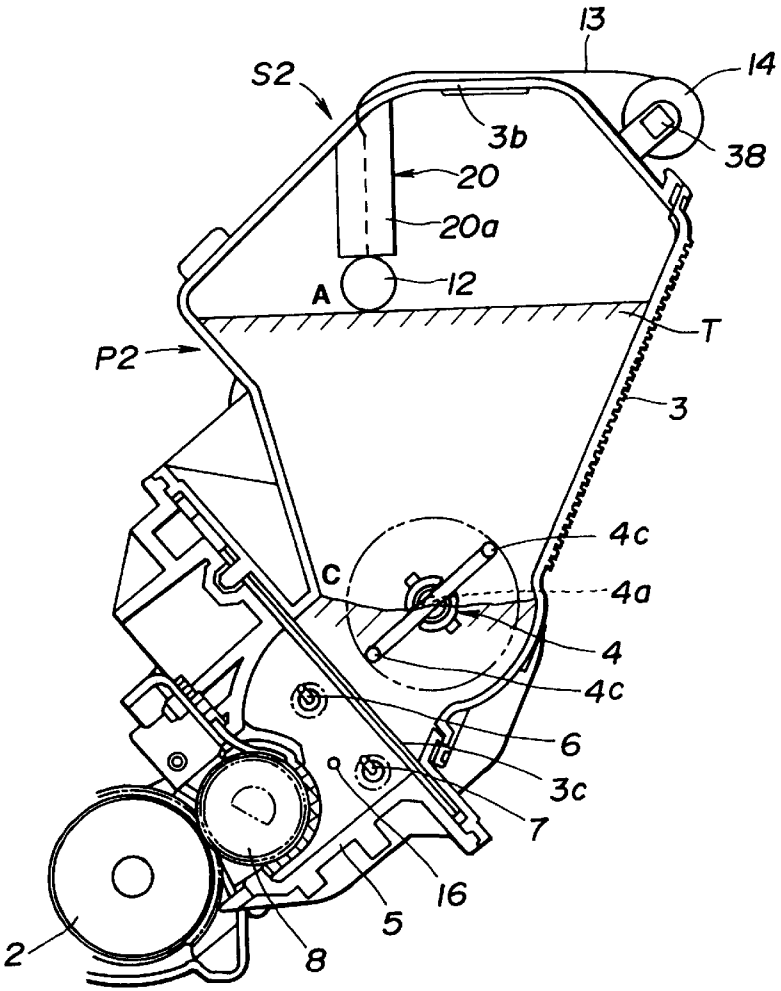
Figure 4B:
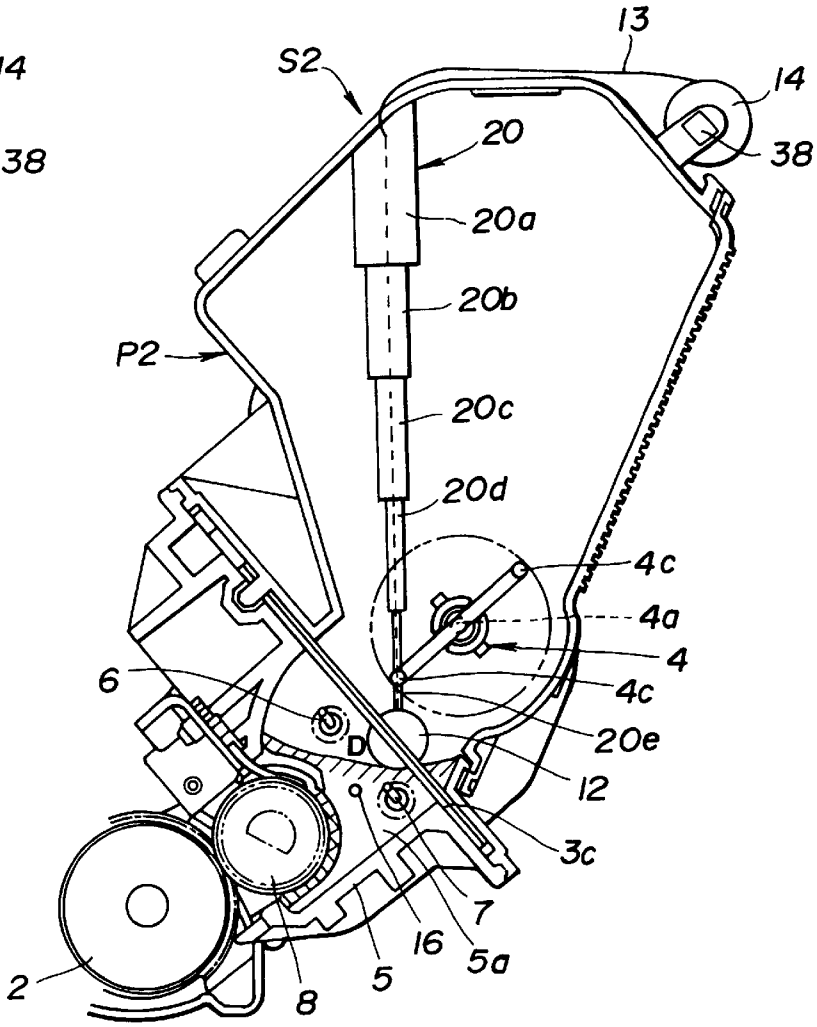
FIGS. 4(*a*) and 4(*b*) are diagrams illustrating the operation of the developer-remaining-amount notifying device shown in FIGS. 3(*a*) and 3(*b*), particularly, the movement of a float in accordance with a gradual consumption of toner.
Figure 4A:
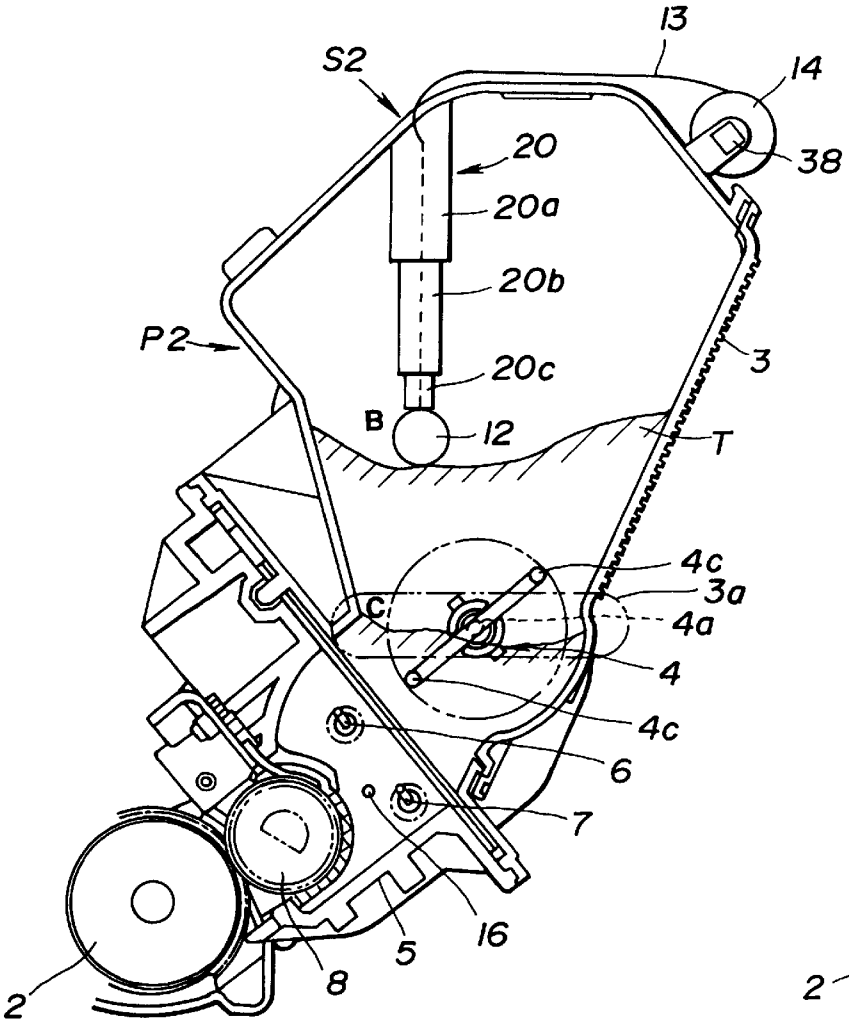

Next, a description will be provided of a developer-remaining-amount notifying device, a process cartridge including such a device, and an image forming apparatus including such a cartridge according to a second embodiment of the present invention with reference to FIGS. 3(*a*) through 4(*b*). FIG. 3(*a*) is a diagram illustrating a cross section of the surrounding structure of a toner receptacle of the process cartridge, and the developer-remaining-amount notifying device. FIG. 3(*b*) is a cross-sectional view of an expansion bar constituting the developer-remaining-amount notifying device. FIGS. 4(*a*) and 4(*b*) are diagrams illustrating the movement of a float of the developer-remaining-amount notifying device in accordance with a gradual consumption of toner.

In FIGS. 3(*a*) through 4(*b*), symbol P2 represents the process cartridge of the second embodiment, which has the same configuration as the process cartridge P1 of the first embodiment. In FIGS. 3(*a*) through 4(*b*), symbol S2 represents the developer-remaining-amount notifying device of the second embodiment, which has the same configuration as the developer-remaining-amount notifying device S1 of the first embodiment, except that an expansion bar 20 expanding in a vertical direction of the toner receptacle 3 is used instead of the regulating member 11 of the first embodiment. That is, the position of the float 12 is regulated by the expansion bar 20.

The expansion bar 20 will now be described.

As shown in FIGS. 3(*a*) and 3(*b*), the expansion bar 20 comprises five cylindrical members 20*a*–20*e*, each having a detachment preventing flange at an upper end thereof, concentrically assembled so as to be expandable in a substantially vertical direction (i.e., the moving direction of the upper surface of the toner layer, which is in a substantially longitudinal direction of the toner receptacle). The expansion bar 20 is disposed so that the float 12 is threaded through a portion near the center of the upper surface of the toner layer, i.e., a portion near the center of the horizontal cross section of the toner receptacle 3, along the shape of the toner receptacle 3. The upper end of the uppermost cylindrical member 20*a* is fixed to the back surface of the upper wall 3*b* of the toner receptacle 3.

The expansion bar 20 is formed so as to expand by the weight of the float 12 fixed at the distal end of the lowermost cylindrical member 20*e*. It is desirable that the expansion bar 20 is adjusted to be at a position where the descent of the float 12 is terminated by the stopper portion 11*a* of the regulating member 11 of the first embodiment in a state in which the expansion bar 20 is completely expanded. For that purpose, the length of the expansion bar 20 in its most expanded state is arranged so that the float 12 passes through the stirrer 4 and the toner supply opening 3*c* present below it and enters the developing chamber 5*a* of the developing unit 5 (see FIG. 4(*b*)).

A thread 13 for returning the float 12 to the upper surface of the toner layer when the float 12 is buried within the toner layer is fixed to the float 12. One end of the string 13 is connected to the float 12 by being threaded through the respective cylindrical members 20*a*–20*e* of the expansion bar 20, and the other end of the thread 13 is accommodated within a string accommodating member 14 by being wound therearound.

In the developer-remaining-amount notifying device S2 having the above-described configuration, in a toner filling process in a process of assembling the process cartridge P2, the expansion bar 20 is contracted by winding the string 13 around the reel 14 before filling the toner, and the float 12 is positioned at an upper portion of the toner receptacle 3. By applying a stopper (not shown) to the reel 14 in this state, wherein the stopper may be released by the user when using the process cartridge P2, the float 12 can be placed on the upper surface of the toner layer as shown in FIG. 3(*a*) (an initial state A).

When the process cartridge P2 has been mounted in the main body 100 (FIG. 8) of the image forming apparatus, and as the toner T within the toner receptacle 3 is gradually consumed, a central portion of the upper surface of the toner layer tends to be concave relative to a portion near the wall of the toner receptacle 3 due, for example, to the flowability of the toner T and the friction of the toner T with the wall of the toner receptacle 3 (a state B as shown in FIG. 4(*a*)). However, since the expansion bar 20 which fixes the float 12 is disposed near the center of the upper surface of the toner layer, the float 12 moving along the expansion bar 20 can always follow the concave portion of the upper surface of the toner layer. Accordingly, even if gathering of the toner occurs due, for example, to a decrease in the flowability of the toner and the friction of the toner with the toner receptacle 3, a portion near the center of the upper surface of the toner layer is not influenced by the gathering of the toner, so that sequential detection of the remaining amount of the toner by the float 12 can be assuredly performed (see FIG. 4(*a*)).

Next, a description will be provided of a case in which the float 12 is positioned at the lower portion 3*a* of the toner receptacle 3 and passes through a portion near the stirrer 4 (a state C) as a result of further consumption of the toner. At that time, the second stirring portion 4*a* of the stirrer 4 is set at substantially the same height as the supporting shaft portions 4*b* and 4*d* and has a smaller radius of rotation than the radius of rotation of the first stirring portions 4*c*. Hence, as shown in FIG. 4(*b*), the second stirring portion 4*a* does not hinder the passage of the float 12 even if the stirrer 4 rotates. Accordingly, a portion near the center of the upper surface of the toner layer is not influenced by the stirrer 4, so that sequential detection of the remaining amount of the toner by the float 12 can be assuredly performed.

When the toner is further consumed and the remaining amount of the toner becomes small (a state D), the sequential detection of the remaining amount of the toner by the float 12 is terminated when the expansion bar 20 is fully expanded (see FIG. 4(*b*)).

As described above, in the developer-remaining-amount notifying device S2 of the second embodiment, as shown in FIGS. 4(*a*) and 4(*b*), as the surface of the toner layer descends, the float 12 also descends following it. In accordance with the descent of the float 12, the respective cylindrical members 20*a*–20*e* of the expansion bar 20 gradually expand in the sequence of 20*a*→20*b*→20*c*→20*d*→20*e*. During this process, the position of the float 12 is always regulated at a portion near the center of the surface of the toner layer by the expansion bar 20.

When the sequential detection of the remaining amount of the toner has been terminated in the above-described manner, the detection of an end of the amount of the toner by the above-described antenna line 16 disposed in parallel to the developing sleeve 8 is performed.

In such a sequential detection of the remaining amount of the toner, the float 12 descends in accordance with changes A→B→C→D of the upper surface of the toner layer, whereby the string 13 is drawn from the reel 14 to rotate the reel 14. As shown in FIG. 8, the tachometer (detection member) 38 outputs an electrical signal corresponding to the amount of rotation of the reel 14 to the control unit 35. The control unit 35 calculates the position of the float 12 based on the electrical signal and converts the obtained value into the remaining amount of the toner.

The control unit 35 displays the current remaining amount of the toner, obtained as a result of sequential detection of the remaining amount of the toner by the float 12, on the display unit 36 (main-body notification unit) provided on the main body 100 of the image forming apparatus, to notify the user of the remaining amount of the toner.

When the sequential detection of the remaining amount of the toner by the float 12 has ended, the fact that a time to exchange the cartridge or to replenish the toner approaches is displayed on the display unit 36 to notify the user of this fact. Thereafter, complete consumption of the toner T by the detection of an end of the amount of the toner by the antenna line 16 is displayed on the display unit 36 (main-body notification unit) to notify the user of this fact.

In the developer-remaining-amount notifying device S2 of the second embodiment, as in the developer-remaining-amount notifying device S1 of the first embodiment, the expansion bar 20 is disposed so as to expand from the upper wall 3*b* to a portion near the base of the toner receptacle 3 so that the float 12 passes through a portion near the center of the upper surface of the toner layer, i.e., near the center of the horizontal cross section of the toner receptacle 3, along the shape of the toner receptacle 3. Hence, the float 12 can descend to a portion near the base of the toner receptacle 3 in accordance with changes in the upper surface of the toner layer due to gradual consumption of the toner, so that the amount of the toner can be determined and the user can be notified of the amount until the remaining amount of the toner is very small.

If the float 12 is buried within the toner layer when, for example, replenishing the toner, the float 12 is first raised by contracting the expansion bar 20 by winding the string 13 (or, in the embodiments described below, the tape 31 or 34) around the reel 14 and the amount of rotation up to this time is reset, and the float 12 is then lowered. Thus, the float 12 again touches the surface of the toner layer, so that the remaining amount of the toner can be detected.

Furthermore, in the developer-remaining-amount notifying device S2 of the second embodiment, in a state in which the float 12 (position detection member) is maintained at a portion near the center of the upper surface of the toner layer by the expansion bar (regulating member) 20 expanding in the moving direction (substantially vertical direction) of the upper surface of the toner layer, the float 12 can descend in accordance with the movement of the upper surface of the toner layer due to gradual consumption of the toner without moving toward the wall of the toner receptacle (developer accommodating unit) 3. Accordingly, it is possible to prevent the problem that the float 12 stops at a portion of gathering of the toner (developer) due, for example, to a decrease in the flowability of the toner and the friction of the toner with the toner receptacle 3 and cannot follow the toner layer, and therefore to perform sequential notification of the remaining amount of the toner.

Third Embodiment

In the foregoing first and second embodiments, a description has been provided of the developer-remaining-amount notifying devices S1 and S2, the process cartridges P1 and P2 including the devices S1 and S2, respectively, and image forming apparatuses including such devices in which the remaining amount of toner is detected by measuring the amount of the string 13 drawn by the float 12 descending in accordance with the movement of the upper surface of the toner layer due to gradual consumption of the toner using the tachometer 38 connected to the reel 14. The remaining amount of the toner may also be detected by using a thin tape instead of the string 13 and optically detecting the amount of movement (the drawn amount) of the tape.

Figure 5:
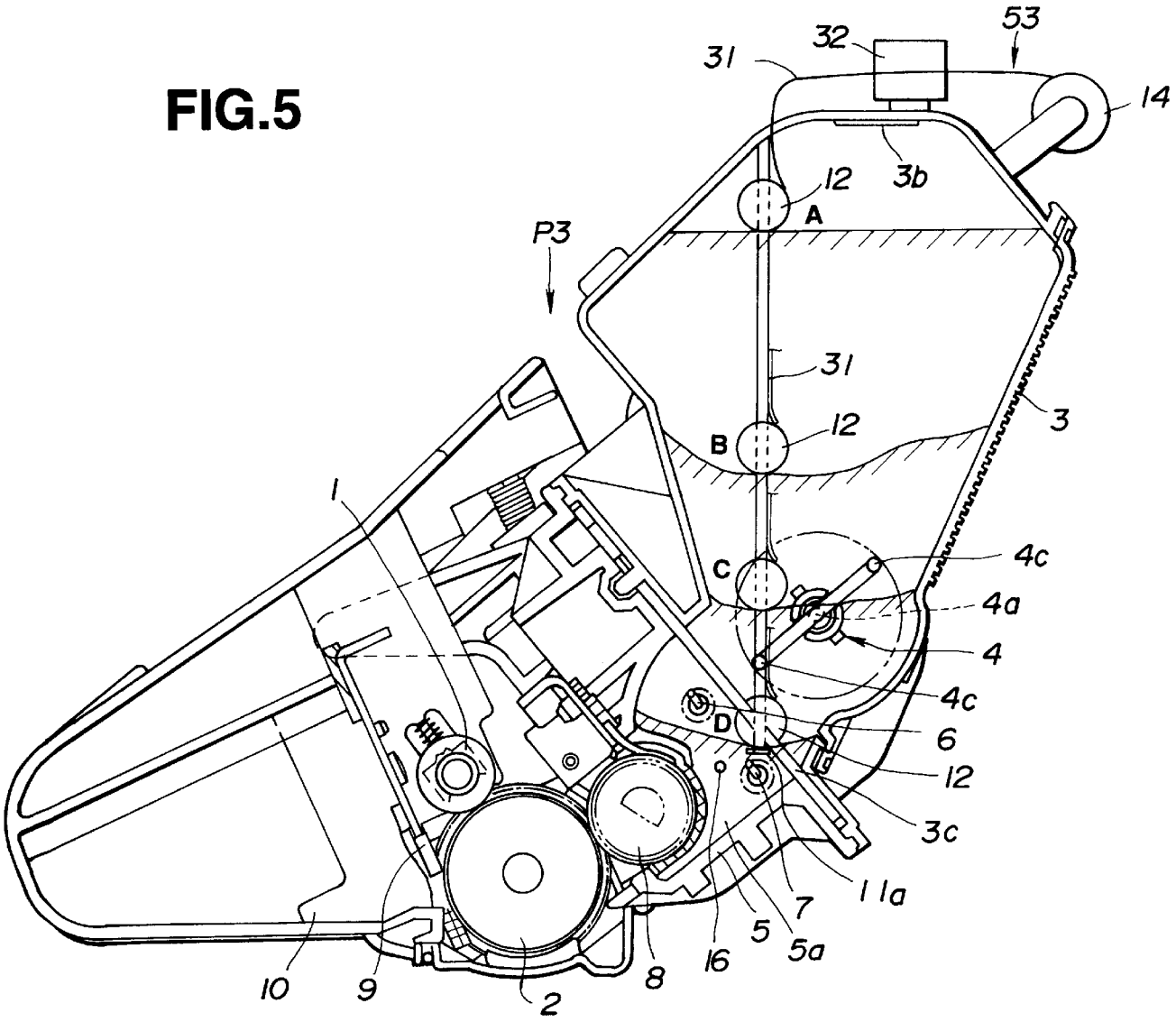
FIG. 5 is a diagram illustrating a process cartridge and a developer-remaining-amount notifying device used in an image forming apparatus according to a third embodiment of the present invention, and shows a cross section of a principal portion of the process cartridge, and the movement of a float of the developer-remaining-amount notifying device in accordance with a gradual consumption of toner.
Figure 6A:
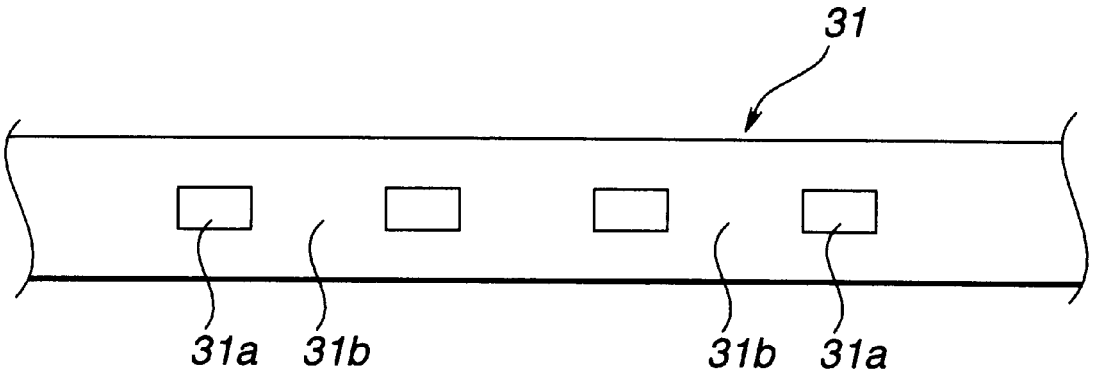
FIGS. 6(*a*) and 6(*b*) are diagrams illustrating a tape and a detector constituting the developer-remaining-amount notifying device shown in FIG. 5.
Figure 6B:
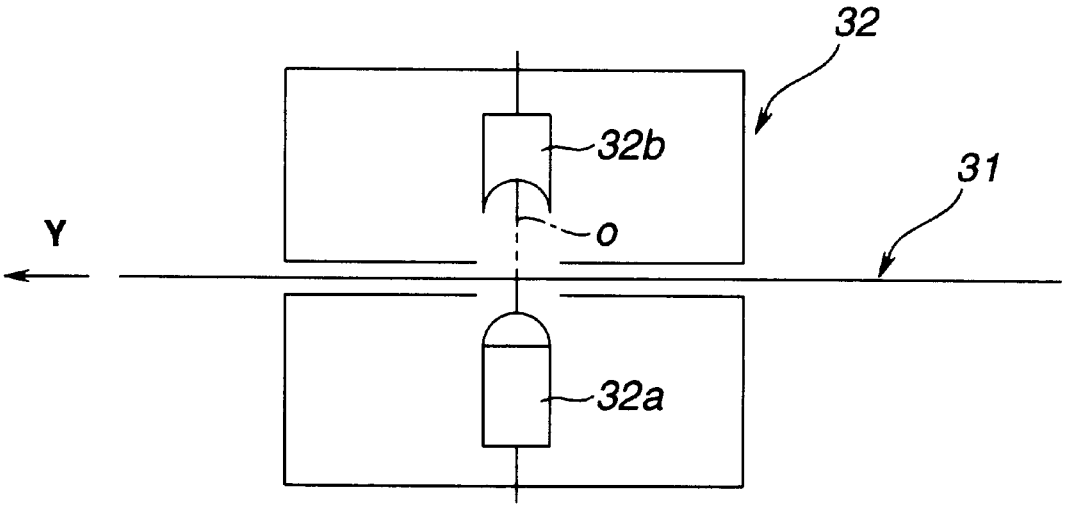

FIGS. 5 through 6(*b*) illustrate a developer-remaining-amount notifying device, a process cartridge using such a device, and an image forming apparatus using such a cartridge according to a third embodiment of the present invention. A process cartridge P3 of the third embodiment has the same configuration as the process cartridge P1 of the first embodiment. A developer-remaining-amount notifying device S3 of the third embodiment has the same configuration as the developer-remaining-amount notifying device S1 of the first embodiment, except that a thin tape 31 processed so that a drawn amount thereof can be optically detected is caused to pass through a detector (detection member) 32 in order to optically detect the amount of movement of the tape 31.

As shown in FIG. 5, one end of the tape 31 is connected to a float 12, and the other end of the tape 31 is mounted on a reel (tape accommodating member) 14 via the detector 32 for optically detecting the amount of movement of the tape 31. As shown in FIG. 6(*a*), light transmitting portions 31*a* and light blocking portions 31*b*, each having the shape of a hole, are alternately provided in the tape 31 along the longitudinal direction of the tape 31.

As shown in FIG. 5, the detector (detection member) 32 is provided on the surface of an upper wall portion 3*b* of a toner receptacle 3. A light-emitting device 32*a* and a photosensor 32*b* are disposed so as to face each other within the detector 32, and the tape 31 passes between these devices 32*a* and 32*b* (see FIG. 6(*b*)). The light-emitting device 32*a* is always lit to project light toward the tape 31. The photosensor 32*b* senses the light from the light-emitting device 32*a*, and outputs a signal corresponding to the amount of movement of the tape 31 to the control unit 35 of the main body 100 of the image forming apparatus.

Although in FIG. 5, the detector 32 is provided outside the toner receptacle 3, the detector 32 may be provided within the toner receptacle 3 together with the reel 14, and may output a signal to the control unit 35 of the main body 100 of the image forming apparatus.

In the developer-remaining-amount notifying device S3 having the above-described configuration, the float 12 descends in accordance with the movement of the upper surface of the toner layer due to gradual consumption of the toner, to rotate the reel 14 and thereby to draw the tape 31. At that time, the tape 31 advances in the direction indicated by an arrow Y shown in FIG. 6(*b*). When one of the light transmitting portions 31*a* of the tape 31 is positioned on an optical axis O between the light-emitting device 32*a* and the photosensor 32*b* of the detector 32, the photosensor 32*b* detects light from the light-emitting device 32*a*. When the tape 31 further advances in the direction indicated by the arrow Y shown in FIG. 6(*b*) and one of light-blocking portions 31*b* is positioned on the optical axis O, the photosensor 32*b* does not detect the light from the light-emitting device 32*a*. The photosensor 32*b* outputs the detection (nondetection) as a signal corresponding to the drawn amount of the tape 31 to the control unit 35 of the main body 100 of the image forming apparatus (see FIG. 8).

By counting the number of repeated detection (nondetection) operations obtained from the photosensor 32*b* of the detector 32, the control unit 35 can obtain the drawn amount of the tape 31, and the position of the float 12. The position of the float 12 is converted into a determination of the remaining amount of the toner.

The control unit 35 sequentially displays the current remaining amount of the toner, obtained as a result of sequential detection of the remaining amount of the toner by the float 12, on the display unit 36 (main-body notification unit) provided on the main body 100 of the image forming apparatus, to notify the user of the remaining amount of toner. Such notification may be accomplished, for example, using a display, a sound, and/or a display to an external apparatus.

When the sequential detection of the remaining amount of the toner by the float 12 has ended, the fact that a time to exchange the cartridge or to replenish the toner approaches is displayed on the display unit 36 to notify the user of this fact. Thereafter, complete consumption of the toner T by the detection of an end of the amount of the toner by the antenna line 16 displayed on the display unit (main-body notification unit) 36 to notify the user of this fact.

Figure 7A:
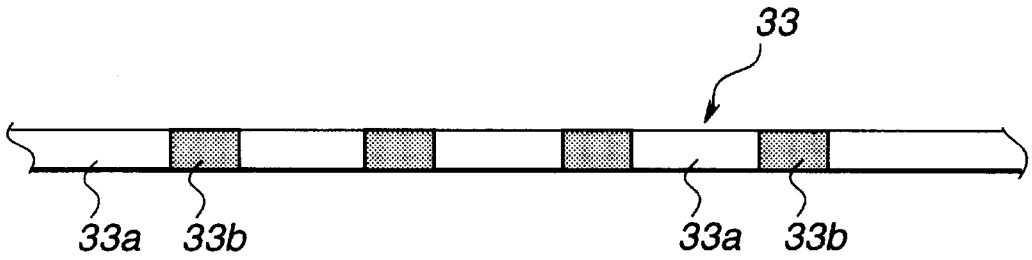
FIGS. 7(*a*) and 7(*b*) are diagrams illustrating a string and a detector constituting the developer-remaining-amount notifying device shown in FIG. 5.
Figure 7B:
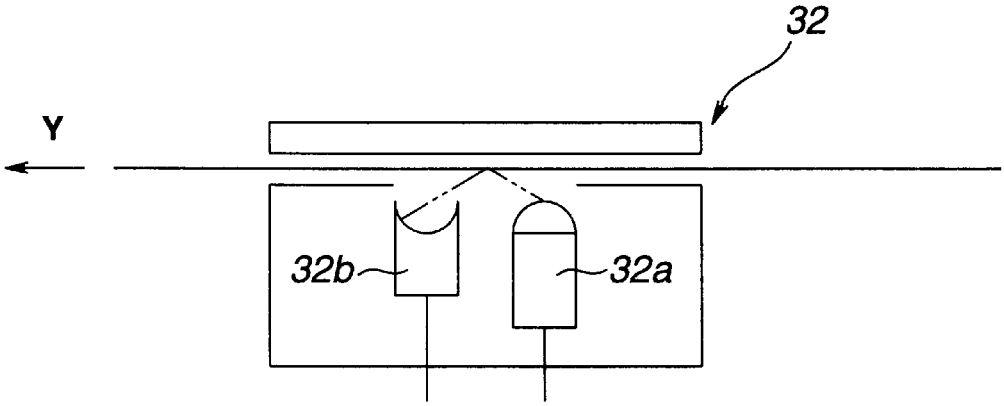

The developer-remaining-amount notifying device S3 may also have a configuration shown in FIGS. 7(*a*) and 7(*b*).

That is, a thread 33 shown in FIG. 7(*a*) may be used instead of the tape 31. The thread 33 may, for example, be made of nylon, in which light reflecting portions 33*a* and light absorbing portions 33*b* are alternately provided in the longitudinal direction. In this case, the light reflecting portion 33*a* may, for example, comprise an aluminum film deposited on the thread 33 in a vacuum. When using the above-described tape 31, an aluminum film deposited on the tape 31 in a vacuum may be used instead of the light transmitting portion 31*a*.

The above-described detector (detection member) 32 may be configured as shown in FIG. 7(*b*). That is, the light-emitting device 32*a* and the photosensor 32*b* may be juxtaposed. According to such a configuration, the size of the detector 32 can be reduced.

When using the string 33, also, as when using the tape 31, the string 33 advances in the direction indicated by an arrow Y shown in FIG. 7(*b*) in accordance with the descent of the float 12. Light reflected by one of the light reflecting portions 33*a* is detected by the photosensor 32*b*, and the photosensor 32*b* does not detect light at the position of the light absorbing portion 33*b*. By counting the number of repeated detection (nondetection) operations, the control unit 35 can determine the drawn amount of the string 33, and the position of the float 12. The position of the float 12 can be converted into a determination of the remaining amount of the toner.

Figure 9A:
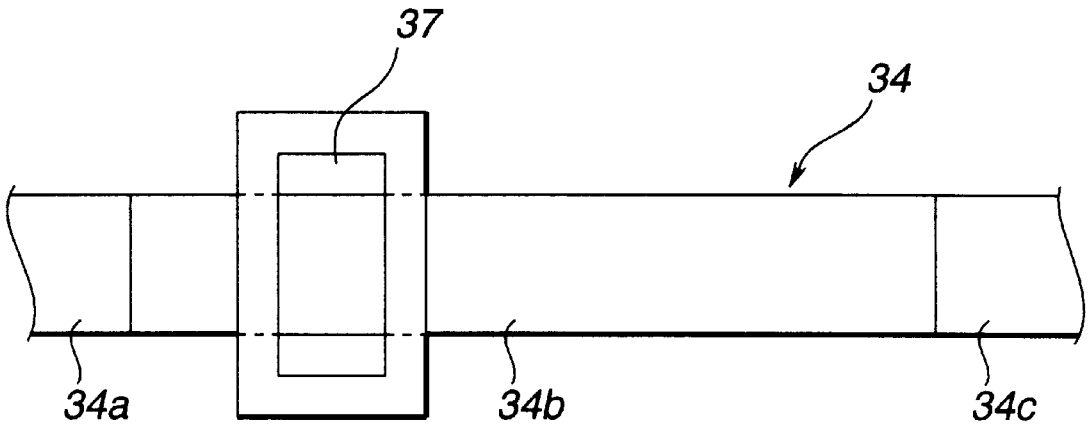
FIGS. 9(*a*) and 9(*b*) are diagrams illustrating a tape and a detection window constituting the developer-remaining-amount notifying device shown in FIG. 5.
Figure 9B:
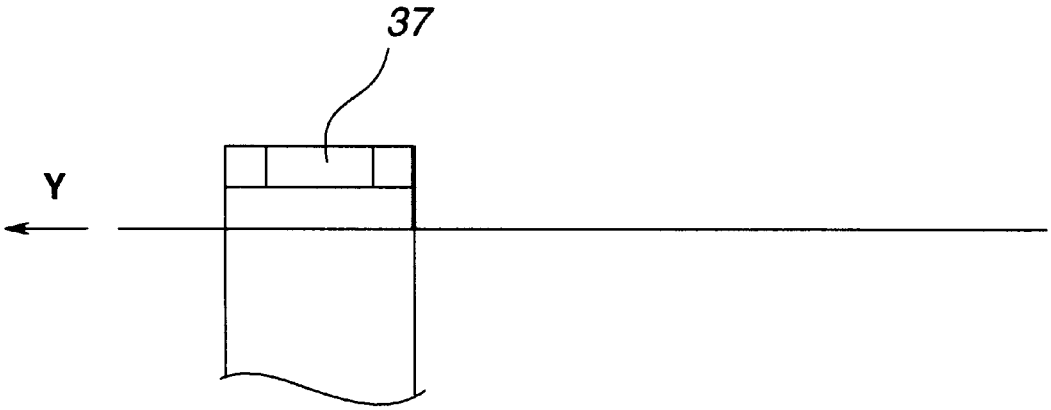

The developer-remaining-amount notifying device S3 may also have a configuration shown in FIGS. 9(*a*) through 10.

That is, a tape 34 shown in FIG. 9(*a*) may be used instead of the above-described tape 31. This tape 34 has portions of a plurality of colors in the longitudinal direction. For example, portions 34*a*, 34*b* and 34*c* are colored in blue, yellow and red, respectively.

Figure 10:
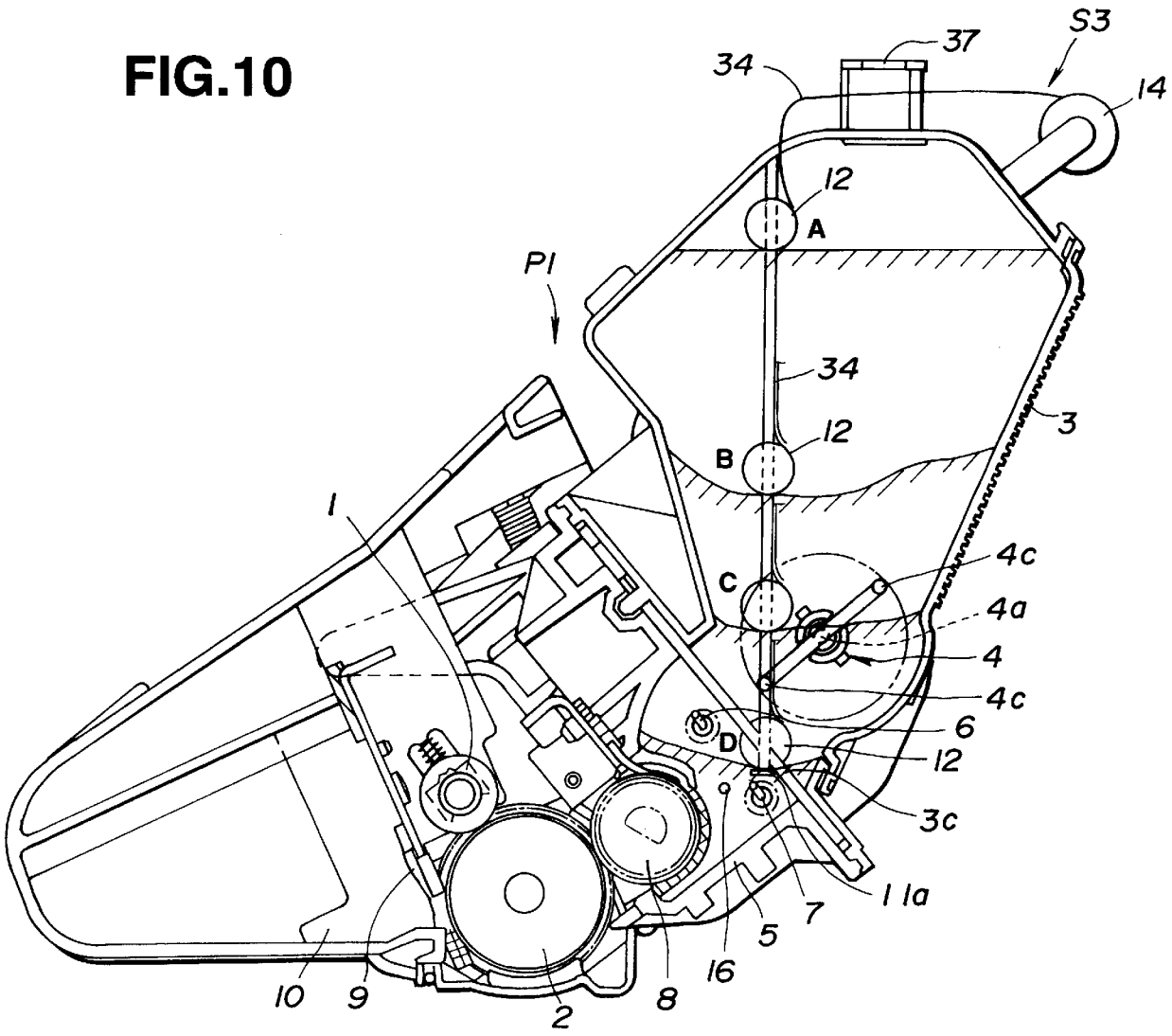
FIG. 10 is a diagram illustrating a cross section of a principal portion of a process cartridge, and the detection window.

As shown in FIG. 10, a detection window 37 for visually recognizing a color of the tape 34 is provided as a component of notification means.

When using this tape 34, also, as when using the tape 31, the float 12 descends as the remaining amount of the developer decreases, and the tape 34 advances in the direction indicated by an arrow Y shown in FIG. 9(*b*). The color of the tape 34 that appears in the detection window 37 changes as the tape 34 advances. For example, when using the tape colored in the above-described manner, the portions 34*a* (blue), 34*b* (yellow) and 34*c* (red) sequentially appear in the detection window 37 in accordance with a gradual decrease in the remaining amount of the developer.

By visually recognizing that the color appears in the detection window 37 by the user, the remaining amount of the toner can be determined and the user can be notified of the amount. For example, in the above-described case, while blue appears in the detection window 37, the user can recognize that the remaining amount of the developer is large. When yellow appears in the detection window 37, the user can recognize that the remaining amount of the developer is less than that corresponding to blue. When red appears in the detection window 37, the user can recognize that the remaining amount of the developer is small.

In the foregoing embodiments, although a description has been provided illustrating the case of using a string or a tape as a component of notification means, the string and the tape may be used by being appropriately replaced by each other. The component of the notification means is not limited to a string or a tape, but any flexible member may also be used.

In the foregoing embodiments, the process cartridge includes charging means, developing means, cleaning means and an electrophotographic photosensitive member integrally formed as a cartridge, and the cartridge is detachably mounted in the main body of the image forming apparatus. However, charging means and developing means, or cleaning means and an electrophotographic photosensitive member may be integrally formed as a cartridge, which is detachably mounted in the main body of the image forming apparatus. Furthermore, at least one of charging means, developing means and cleaning means, and an electrophotographic photosensitive member may be integrally formed as a cartridge, which is detachably mounted in the main body of the image forming apparatus. In addition, at least developing means and an electrophotographic photosensitive member may be integrally formed as a cartridge, which is detachably mounted in the main body of the image forming apparatus.

As described above, according to the present invention, since the regulating member regulates the moving direction of the position detection member so as to substantially linearly move in accordance with a gradual decrease of the developer accommodated in the developer accommodating unit due to gradual consumption of the developer, sequential notification of the remaining amount of the developer can be performed.

The individual components shown in outline in the drawings are all well-known in the developer-remaining-amount notifying device, process cartridge and electrophotographic image forming apparatus arts and their specific construction and operation are not critical to the operation or the best mode for carrying out the invention.

While the present invention has been described with respect to what are presently considered to be the preferred embodiments, it is to be understood that the invention is not limited to the disclosed embodiments. To the contrary, the present invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A developer indicating device for indicating a remaining amount of developer accommodated in a developer accommodating unit and used for developing a latent image formed on an electrophotographic photosensitive member, said device comprising:

a position detection member positionable near an upper surface of an accumulated layer of the developer accommodated in the developer accommodating unit;

a regulating member for regulating a moving direction of said position detection member; and indication means for indicating the remaining amount of developer accommodated in the developer accommodating unit in accordance with a position of said position detection member, said indication means comprising a flexible longitudinal member having said position detection member provided on one end thereof, and a detection member for detecting movement of said longitudinal member, wherein the remaining amount of developer accommodated in the developer accommodating unit is indicated based on the amount of movement of said longitudinal member detected by said detection member.

2. A device according to claim 1, wherein said regulating member regulates the moving direction of said position detection member such that said position detection member moves substantially linearly in accordance with a gradual decrease of developer accommodated in the developer accommodating unit as the developer is used for development.

3. A device according to claim 2, wherein said regulating member is provided within a region of the developer accommodating unit where the accumulated layer of the developer averagely decreases.

4. A device according to claim 3, wherein said regulating member is expandable in a substantially longitudinal direction of the developer accommodating unit, and expands in accordance with a descent of said position detection member.

5. A device according to claim 1, wherein said longitudinal member comprises a string and said indication means further comprises, an accommodating member connected to the other end of said longitudinal member and for accommodating said longitudinal member, said accommodating member moving in accordance with a longitudinal directional movement of said longitudinal member to draw out said longitudinal member from said accommodating member and wherein said detection member detects an amount of movement of said accommodating member and the remaining amount of developer accommodated in the developer accommodating unit is indicated based on the amount of movement of said accommodating member detected by said detection member.

6. A device according to claim 1, wherein said longitudinal member comprises a tape including portions having a plurality of colors in a longitudinal direction of said tape and said detection member comprises a detection window through which a color of said tape may be visually recognized, and wherein the remaining amount of developer accommodated in the developer accommodating unit is indicated based on the color that appears in said detection window.

7. A device according to claim 1, wherein said position detection member is configured such that, when said position detection member is buried in the developer accommodated in the developer accommodating unit, said position detection member returns to a position near the upper surface of the accumulated layer of the developer by drawing said longitudinal member.

8. A device according to claim 1, wherein said longitudinal member comprises a tape having a plurality of holes formed in a longitudinal direction of said tape and said detection member comprise a light-emitting device and a photosensor for detecting a number of the holes which have passed therethrough, and wherein the remaining amount of developer accommodated in the developer accommodating unit is indicated based on the number of the holes detected by said detection member.

9. A device according to claim 8, wherein said position detection member is configured such that, when said position detection member is buried in the developer accommodated in the developer accommodating unit, said position detection member returns to a position near the upper surface of the accumulated layer of the developer by drawing the tape.

10. A device according to claim 1, wherein said longitudinal member comprises a tape having light reflecting portions and light absorbing portions alternatively provided in a longitudinal direction of said tape, and said detection member further comprises a light-emitting device and a photosensor, for detecting a number of the light reflecting portions which have passed therethrough, and wherein the remaining amount of developer accommodated in the developer accommodating unit is indicated based on the number of the light reflecting portions detected by said detection member.

11. A device according to claim 10, wherein said position detection member is configured such that, when said position detection member is buried in the developer accommodated in the developer accommodating unit, said position detection member returns to a portion near the upper surface of the accumulated layer of the developer by drawing said tape.

12. A process cartridge detachably mountable on a main body of an electrophotographic image forming apparatus, said process cartridge comprising:

an electrophotographic photosensitive member;

developing means including a developing member for developing a latent image formed on said electrophotographic photosensitive member, and a developer accommodating unit for accommodating developer used by said developing member for development; and a developer indication unit for indicating a remaining amount of developer accommodated in said developer accommodating unit, said developer indication unit including:

a position detection member positionable near an upper surface of an accumulated layer of the developer accommodated in said developer accommodating unit;

a regulating member for regulating a moving direction of said position detection member; and indication means for indicating a remaining amount of developer accommodated in said developer accommodating unit in accordance with a position of said position detection member, said indication means comprising a flexible longitudinal member having said position detection member provided on one end thereof, and a detection member for detecting movement of said longitudinal member, wherein the remaining amount of developer accommodated in the developer accommodating unit is indicated based on the amount of movement of said longitudinal member detected by said detection member.

13. A process cartridge according to claim 12, wherein said regulating member regulates the moving direction of said position detection member such that said position detection member moves substantially linearly in accordance with a gradual decrease of developer accommodated in the developer accommodating unit as developer is used for development.

14. A process cartridge according to claim 13, wherein said regulating member is provided within a region of said developer accommodating unit where the accumulated layer of the developer averagely decreases.

15. A process cartridge according to claim 14, wherein said regulating member is expandable in a substantially longitudinal direction of said developer accommodating unit, and expands in accordance with a descent of said position detection member.

16. A process cartridge according to claim 12, wherein said longitudinal member comprises a string and said indication means further comprises, an accommodating member connected to the other end of said longitudinal member and for accommodating said longitudinal member, said accommodating member moving in accordance with a longitudinal direction movement of said longitudinal member to draw out said longitudinal member from said accommodating member, and wherein said detection member detects an amount of movement of said accommodating member and the remaining amount of developer accommodated in the developer accommodating unit is indicated based on the amount of movement of said accommodating member detected by said detection member.

17. A process cartridge according to claim 12, wherein said longitudinal member comprises a tape including portions having a plurality of colors in a longitudinal direction of said tape and said detection member comprises a detection window through which a color of said tape may be visually recognized, and wherein the remaining amount of developer accommodated in the developer accommodating unit is indicated based on the color that appears in said detection window.

18. A process cartridge according to claim 12, wherein said position detection member is configured such that, when said position detection member is buried in the developer accommodated in the developer accommodating unit, said position detection member returns to a portion near the upper surface of the accumulated layer of the developer by drawing said longitudinal member.

19. A process cartridge according to claim 12, wherein said longitudinal member comprises a tape having a plurality of holes formed in a longitudinal direction of said tape and said detection member comprises a light-emitting device and a photosensor for detecting a number of the holes which have passed therethrough and wherein the remaining amount of developer accommodated in the developer accommodating unit is indicated based on the number of the holes detected by said detection member.

20. A process cartridge according to claim 19, wherein said position detection member is configured such that, when said position detection member is buried in the developer accommodated in the developer accommodating unit, said position detection member returns to a portion near the upper surface of the accumulated layer of the developer by drawing said tape.

21. A process cartridge according to claim 12, wherein said longitudinal member comprises a tape having light reflecting portions and light absorbing portions alternatively provided in a longitudinal direction of said tape and said detection member comprises a light-emitting device and a photosensor for detecting a number of the light reflecting portions which have passed therethrough, and wherein the remaining amount of developer accommodated in the developer accommodating unit is indicated based on the number of the light reflecting portions detected by said detection member.

22. A process cartridge according to claim 21, wherein said position detection member is configured such that, when said position detection member is buried in the developer accommodated in the developer accommodating unit, said position detection member returns to a portion near the upper surface of the accumulated layer of the developer by drawing said tape.

23. A process cartridge according to claim 12, further comprising:

a stirring member for stirring the developer accommodated in said developer accommodating unit, said stirring member having a stirring shaft, both ends of which are supported on said developer accommodating unit, wherein said stirring shaft includes in a longitudinal direction a first stirring portion having a first radius of rotation; and second stirring portions, each having a radius of rotation smaller than the first radius of rotation and configured so as not to interfere with said position detection member.

24. A processs cartridge according to claim 23, wherein the process cartridge further includes:

an antenna member provided in the developer accommodating unit; and auxiliary indication means for indicating a remaining amount of developer accommodated in the developer accommodating unit according to a change in electrostatic capacitance between the antenna member and the developing means, wherein the auxiliary indication means indicates a remaining amount of developer that is smaller than the remaining amount of developer indicated by the indication means.

25. A process cartridge according to claim 12, further comprising:

an antenna member provided in said developer accommodating unit; and auxiliary indication means for indicating a remaining amount of developer accommodated in said developer accommodating unit according to a change in electrostatic capacitance between said antenna member and said developing means, wherein said auxiliary indication means indicates a remaining amount of developer which is smaller than the remaining amount of developer indicated by said indication means.

26. An electrophotographic image forming apparatus for forming an image on a recording medium, said apparatus comprising:

(a) a mounting unit for detachably mounting a process cartridge, the process cartridge including:

an electrophotographic photosensitive member;

developing means including a developer accommodating unit for accommodating developer for developing a latent image formed on the electrophotographic photosensitive member; and a developer indication unit for indicating a remaining amount of developer accommodated in the developer accommodating unit, the developer indication unit including, a position detection member positionable near an upper surface of an accumulated layer of the developer accommodated in the developer accommodating unit;

a regulating member for regulating a moving direction of the position detection member; and indication means for indicating the remaining amount of developer accommodated in the developer accommodating unit in accordance with a position of the position detection member, said indication means comprising a flexible longitudinal member having said position detection member provided on one end thereof, and a detection member for detecting movement of said longitudinal member, wherein the remaining amount of developer accommodated in the developer accommodating unit is indicated based on the amount of movement of said longitudinal member detected by said detection member; and (b) a main body indication unit for indicating the remaining amount of developer accommodated in the developer accommodating unit by receiving a signal from the indication means when the process cartridge is mounted to said mounting unit.

27. An apparatus according to claim 26, wherein said main body indication unit performs notification using a sound.

28. An apparatus according to claim 26, wherein said main body indication unit performs notification using a display.

29. An apparatus according to claim 26, wherein said main body indication unit performs notification using a display of an external apparatus.

* * * * *

UNITED STATES PATENT AND TRADEMARK OFFICE

CERTIFICATE OF CORRECTION

PATENT NO. : 5,923,918

DATED : July 13, 1999

INVENTOR(S): TAKAO NAKAGAWA, ET AL.

Figure 2A:
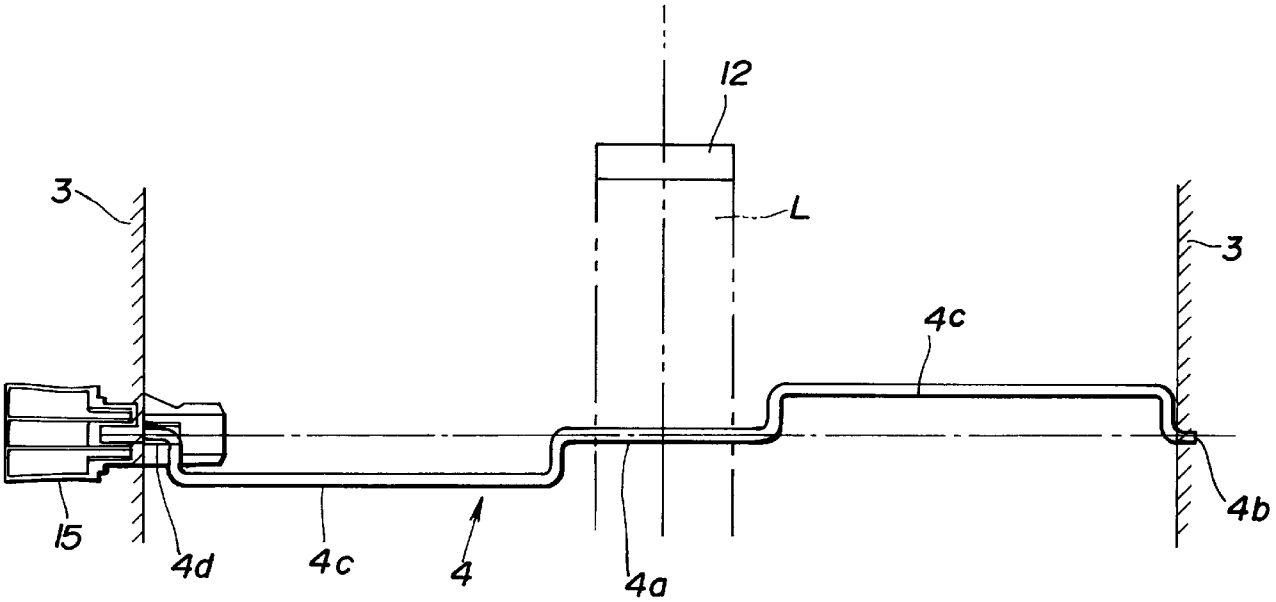

It is certified that error appears in the above-identified patent and that said Letters Patent is hereby corrected as shown below:

COLUMN 6,
Line 52, "(see FIG. 2(a)," should read --(see FIG. 2(a))),--.

COLUMN 18,
Line 42, "processs" should read --process--.

Signed and Sealed this

Twenty-second Day of May, 2001

*Attest:*

Nicholas P. Godici

NICHOLAS P. GODICI

*Attesting Officer*

*Acting Director of the United States Patent and Trademark Office*